United States Patent [19]

Lynch

[11] 4,017,172

[45] Apr. 12, 1977

[54] DOCUMENT FEEDING APPARATUS

[75] Inventor: Thomas Lynch, Fairport, N.Y.

[73] Assignee: Xerox Corporation, Stamford, Conn.

[22] Filed: Apr. 24, 1975

[21] Appl. No.: 571,113

[52] U.S. Cl. ..... 355/8; 29/132; 355/51

[51] Int. Cl.[2] ..... G03G 15/30

[58] Field of Search ..... 355/8, 50, 51, 75, 76, 355/99–103; 29/132; 226/190–194; 271/109, 264

[56] References Cited

UNITED STATES PATENTS

| | | | |
|---|---|---|---|
| 3,069,990 | 12/1962 | Eisbein et al. | 355/103 X |
| 3,462,058 | 8/1969 | Redman | 226/191 |
| 3,747,918 | 7/1973 | Margulis et al. | 271/275 X |
| 3,788,638 | 1/1974 | Lehmann | 271/109 X |
| 3,858,975 | 1/1975 | Knechtel et al. | 355/50 |
| 3,866,572 | 2/1975 | Gundlach | 355/3 TR |
| 3,901,594 | 8/1975 | Robertson | 355/11 X |

*Primary Examiner*—L. T. Hix
*Assistant Examiner*—Kenneth C. Hutchison
*Attorney, Agent, or Firm*—James J. Ralabate; Michael H. Shanahan; Paul Weinstein

[57] ABSTRACT

A document feeding apparatus and electrostatographic reproducing machine. The apparatus includes a viewing platen and a document feeder for feeding documents over the platen. The document feeder includes at least one feed member urged against the platen to form a nip therebetween for passage of documents. The feed member is formed of a multi-component material comprising a solid polymeric component impregnated with a non-volatile liquid. The multi-component material is selected to reduce the difference between the coefficient of friction between the feed member and the platen and the coefficient of friction between the document and the platen.

11 Claims, 4 Drawing Figures

DOCUMENT FEEDING APPARATUS

BACKGROUND OF THE INVENTION

This invention relates to an apparatus for feeding individual sheets over a transparent platen. The apparatus is particularly adapted for use as a document feeder for a reproducing machine.

Numerous document feeders for use with reproducing machines are known as exemplified by U.S. Pat. Nos. 3,499,710, granted Mar. 10, 1970, to Sahley; 3,556,512, granted Jan. 19, 1971, to Fackler; 3,674,363, granted July 4, 1972, to Baller, et al, and 3,790,158, granted Feb. 5, 1974, to Summers, et al. These patents are representative of the broad prior art in this area directed to document feeders for placing a document on a transparent viewing platen for viewing by the optics of a reproducing machine for making copies of the document. The first named patent shows the use of friction rolls for transporting the document over the platen, and the remaining patents show the use of belt type transport devices.

An alternative type document feeder for use with a reproducing machine is that set out in U.S. application Ser. No. 367,996, filed June 7, 1973, to Hoppner et al., now U.S. Pat. No. 3,900,258. In accordance with the subject application a scanning optical system is fixed adjacent one margin of a transparent viewing platen and a document feeder is positioned overlying the optics to advance documents past the fixed optical system at a speed synchronized to the speed of an image receiving member. This type of feeder is now employed commercially in the Xerox 3100/LDC copier.

A problem which sometimes occurs with respect to document feeders for moving original exposure is a skips and smears copy defect. For example, the document feeder of the above-noted application moves the document at a synchronized speed with respect to the photosensitive surface or other image receiving surface to provide a flowing light image of the original which is projected on the photosensitive surface. The document feeder of the above-noted application includes a sliding carriage having a first set of pinch rolls which advance the document over the viewing portion of the transparent platen and a second set of feed rolls overlying the platen which receive the lead edge of the sheet and then act upon the sheet to continue its transport after the trailing edge has left the pinch rolls. As the lead edge of the sheet intercepts the rolls overlying the platen, there can be a non-synchronous movement of the sheet which results in a skip or smear in the image on the resulting copy sheet.

The non-synchronous movement can be caused by a momentary hesitation of the sheet as it enters the pinch between the feed rolls and the platen. This hesitation can be reduced by reducing the normal force exerted by the rolls against the platen in the manner set forth in U.S. application Ser. No. 464,725, filed Apr. 26, 1974 to Van Buskirk now U.S. Pat. No. 3,909,129.

It has now been found that for a sliding document feeder carriage having feed rolls formed of a conventional material such as polyurethane the forces exerted on the carriage by the frictional engagement between the feed rolls and the platen can be greater than the latching force designed to hold the carriage in its operating position. This can result in a displacement of the carriage in the direction opposite to the direction of document travel. The carriage maintains this position until a document enters the nip between the feed roll and the platen. The coefficient of friction between the glass platen and the document is lower than the roll to platen friction and, therefore, the force driving the carriage out of position is substantially reduced. As a result the carriage returns to its operating position at a velocity higher than the acceptable document velocity thus creating an unacceptable skip in the resulting image on the copy sheet. This problem can be further aggravated due to the humidity sensitivity of the feed roll material. It has been found that in relatively high humidity, polyurethane rolls absorb moisture which further increases its coefficient of friction relative to the platen thereby making the problem worse.

A partial solution to this problem is to more securely latch the carriage in its operative position as by the use of a mechanism as described in U.S. patent application Ser. No. 482,739, filed June 24, 1974, to VanBuskirk now U.S. Pat. No. 3,944,365. However, even this approach is not a full answer to this problem due to the mismatch between the roll to platen and document to platen coefficients of friction.

In accordance with this invention this mismatch in coefficient of friction is substantially reduced through the use of a multi-component feed roll material most preferably comprising polyurethane impregnated with silicone oil. This material also exhibits a greater degree of moisture insensitivity as compared to polyurethane alone and other similar materials.

Silicone oil impregnated silicone rubber has been employed in fuser rolls as in U.S. Pat. No. 3,731,353, to Artl. The use of porous rolls impregnated with a non-volatile liquid to prevent off-setting when used as a transport roll for forwarding sheets having on a surface a non-dry tacky material is described in United Kingdom Pat. No. 1,257,498, published Dec. 22, 1971.

SUMMARY OF THE INVENTION

In accordance with this invention an apparatus is provided for feeding individual documents over a transparent viewing platen. The apparatus includes means for feeding the documents over the platen. The feeding means includes at least one feed member urged against the platen to form a nip therebetween for passage of the document. The feed member is formed of a multi-component material comprising a solid polymeric component impregnated with a non-volatile liquid component.

The multi-component material is selected so as to reduce the difference between the coefficient of friction between the feed member and the platen and the coefficient of friction between the document and the platen. By reducing the difference between these coefficients of friction the resultant forces acting on the document feeder do not vary as much, irrespective of whether or not a sheet is being fed. This substantially reduces the occurrence of non-synchronous movement of the sheet due to the compliance of the document feeder. Preferably the non-volatile liquid acts as a moisture barrier which makes the material less sensitive to moisture effects which can increase the frictional mismatch.

Preferably, the feed member comprises a roll and the difference between the roll-to-platen coefficient of friction and the sheet-to-platen coefficient of friction is less than about .8 and most preferably less than about 0.5 as measured with a clean platen and a clean roll at about 65 percent relative humidity.

A preferred material in accordance with this invention comprises a solid polyurethane component impregnated with a silicone oil component. Most preferably the silicone oil component comprises 10 percent by weight of the material.

A reproducing apparatus employing the sheet feeding apparatus of this invention also forms part of this invention. Preferably, the reproducing apparatus comprises an electrostatographic reproducing apparatus.

Accordingly, it is an object of this invention to provide an improved apparatus for feeding sheets over a transparent platen.

It is a further object of this invention to provide an apparatus as above including a feed member formed of a multi-component material.

It is a further object of this invention to provide an apparatus as above having reduced frictional mismatch and reduced humidity sensitivity.

It is a further object of this invention to provide a reproducing machine including the above-noted sheet feeding apparatus.

These and other objects will become more apparent from the following brief description and drawings.

DETAILED DESCRIPTION OF THE PREFERRED EMBODIMENTS

In accordance with this invention an apparatus is provided for feeding individual sheets over a transparent platen. Various document feeding mechanisms are known in the prior art as set forth above. Most of these mechanisms by virtue of their design are compliant to a certain degree, namely, they can be moved or deflected to a limited extent from their operational positions upon application of various resultant or reaction forces which act upon the feeder during operation. The degree of compliance is dependent upon the rigidity of the apparatus and the tolerances of the various parts. Some degree of compliance is present in all systems is for no other reason than the stack-up in tolerances of the various parts making up the document feeder.

It has been found in accordance with this invention that a variation in the forces exerted upon the feeder can occur depending on whether or not a sheet is being fed. This variation has been found to at least in part be the result of the differences in the frictional characteristics of the feed member and the sheets being fed. The coefficient of friction between the feed member and the platen is generally higher than the coefficient of friction between the sheet and the platen. This results in higher reaction forces being applied against the feeder when no sheet is being fed than when a sheet is being fed. Depending upon the degree of feeder compliance, this difference in the reaction forces can result in a substantial displacement of the feeder out of its operative position when no sheet is being fed. Upon the feeding of a sheet, it would then return to the operative position. This return of the feed member to its operative position is in the direction of sheet travel and, therefore, results in a momentary increase in the relative velocity of the sheet which can result as aforenoted in a skip or smear in the resulting copy sheet.

The frictional mismatch is further aggravated in the prior art devices by the humidity sensitivity of the feed member materials. It has been found that with materials such as polyurethane, high humidity can cause its coefficient of friction with respect to glass to icrease. This further increasing the frictional mismatch of the feed member thereby increasing the propensity for skips and smears to occur.

In accordance with this invention a sheet or document feeding apparatus is provided which substantially reduces the occurrence of such non-synchronous movements of the sheet and which is highly humidity insensitive.

The apparatus of this invention has been applied to a reproducing machine of the type set out in the above-noted U.S. application Ser. No. 367,996. For purposes of example therefor, specific reference will now be made to the reproducing machine of the aforenoted application and to the document feeding apparatus in accordance with this invention incorporated in it.

Figure 1:
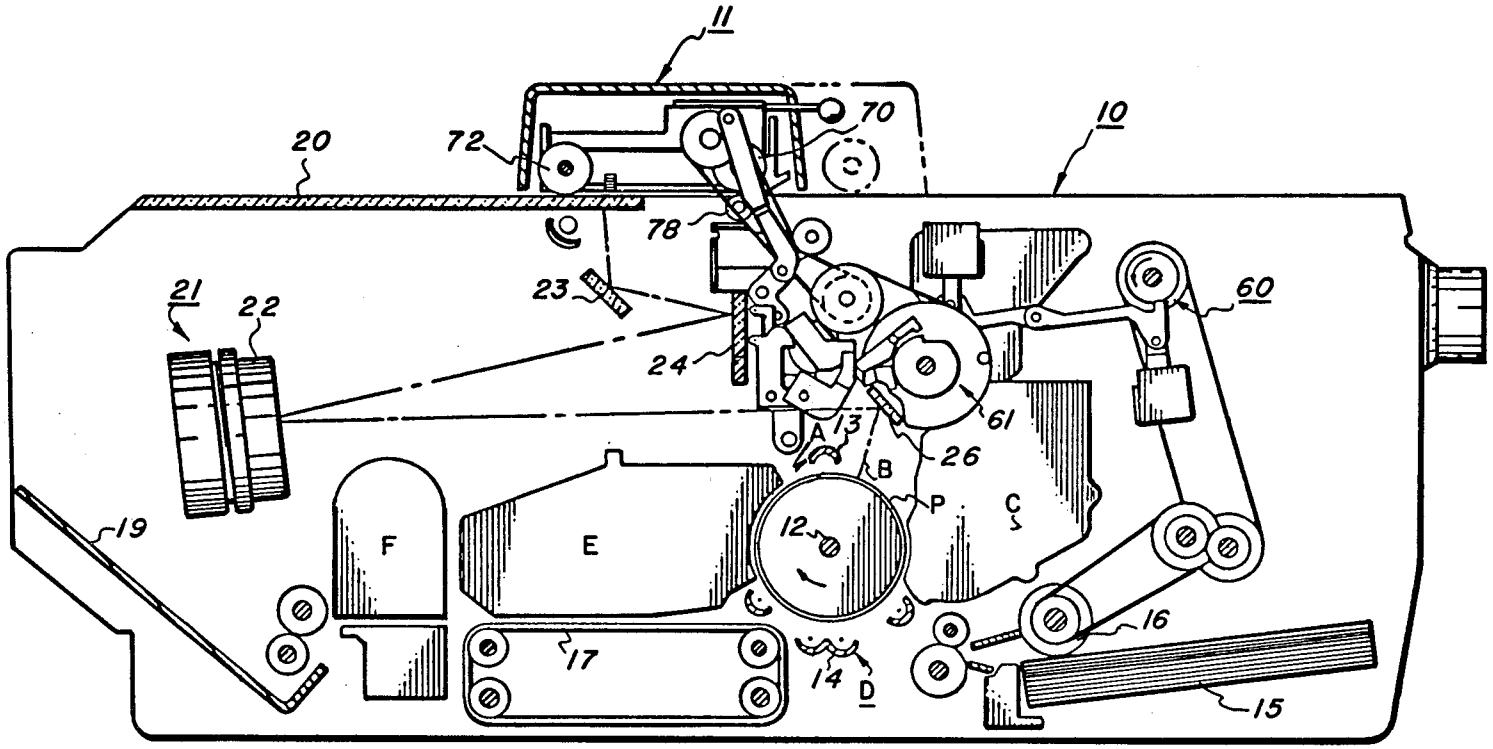
FIG. 1 is a schematic representation of a reproducing machine including a sheet feeding apparatus in accordance with one embodiment of the present invention.

Referring now to FIG. 1, there is illustrated a schematic side view of a compact automatic xerographic copying machine 10 incorporating the sheet feeding apparatus 11 of the present invention. The term compact copier, as herein used, refers to a machine of relatively small size, as for example, a desk type copier. Basically, the xerographic processor includes a rotatably mounted photoconductive drum P which is supported upon a horizontally extended shaft 12. The drum is driven in the direction indicated whereby its photoconductive surface is caused to pass sequentially through a series of xerographic processing stations.

Because the xerographic process is widely known and used in the art, the various processing steps involved will be briefly explained below in reference to FIG. 1. Initially, the photoconductive drum surface is uniformly charged by means of a corona generator 13 positioned within a charging station A located at approximately the 12 o'clock drum position. The charged drum surface is then advanced into an imaging station B wherein a flowing light image of an original document to be reproduced is projected onto the charged drum surface thus recording on the drum a latent electrostatic image containing the original input scene information. Next, subsequent to the exposure step in the direction of drum rotation is a developing station C wherein the latent electrostatic image is rendered visible by applying an electroscopic marking powder (toner) to the photoreceptor surface in a manner well known and used in the art. The now visible image is then forwarded into a transfer station D wherein a sheet of final support material is brought into overlying moving contact with the toner image and the image transferred from the plate to the support sheet by means of a second corona generator 14.

In operation, a supply of cut sheets are supported within the machine by means of a removable paper cassette 15. A pair of feed rollers 16 are arranged to operatively engage the uppermost sheet in the cassette so as to first separate the top sheet from the remainder of the stack and then advance the sheet into the transfer station in synchronous moving relationship to the developed image on the photoconductive plate surface. The motion of the feed rollers is coordinated with that of the rotating drum surface, as well as the other machine components through the main drive system whereby the support sheet is introduced into the transfer station in proper registration with the developed toner image supported on the xerographic plate.

After transfer, but prior to the reintroduction of the imaged portion of the drum into the charging station, the plate surface is passed through a cleaning station E wherein the residual toner remaining on the plate surface is removed. The removed toner particles are collected within a container where they are stored subject to periodic removal from the machine.

Upon completion of the image transfer operation, the toner bearing support sheet is stripped from the drum surface and placed upon a moving vacuum transport 17 which serves to advance the support sheet into a thermal fusing station F wherein the toner image is permanently fixed to the sheet. The copy sheet with the fused image thereon is forwarded from the fuser into a collecting tray 19 where the sheet is held until such time as the operator has occasion to remove it from the machine.

Normally, when the copier is operated in a conventional mode, the original document to be reproduced is placed image side down upon a horizontal transparent viewing platen 20 and the stationary original then scanned by means of the moving optical system 21. The scanning system 21 fundamentally consists of a stationary lens system 22 positioned below the right hand margin of the platen as viewed in FIG. 1, and a pair of cooperating movable scanning mirrors 23 and 24. The lens is basically a half-lens objective having a reflecting surface at the stop position to simulate a full lens system. The two mirrors are slidably supported between a pair of parallel horizontally aligned guide rails (not shown). For a further description and greater details concerning this type of optical scanning system reference is had to U.S. Pat. No. 3,832,057, filed in the name of Shogren.

In practice, mirror 23, herein referred to as the full rate scan mirror, is caused to move from a home position, directly below the left hand margin of the platen to an end of scan position below the opposite margin of the platen. The rate of travel of the scan mirror is equal to the peripheral speed of the rotating xerographic drum surface P. The second mirror 24 is simultaneously caused to move in the same direction as the scanning mirror at half the scanning rate. As the two mirrors sweep across the platen surface, an image of each incremental area thereon viewed by the scanning mirror is reflected towards the second mirror which, in turn, redirects the image back to the half lens system. The reflecting surface, positioned at the lens stop position, reverses the entering light rays and redirects the light rays back towards a stationary mirror 26 positioned directly above the drum surface at the exposure station B. In this manner a flowing light image containing the original input scene information is focused upon the charged photoconductive plate.

A wind up spring (not shown) is provided to restore the moving mirrors to a start of scan condition.

The copying apparatus 10 shown in FIG. 1 is provided with a document feeder 11 in accordance with this invention. The document feeder 11 is movable between a first stored position adjacent to the viewing platen 20 and a second operative position over the platen surface. Commensurate with the positioning of the feeder assembly over the platen, the moving optical system 21 is locked in a position to view documents as they are advanced by the document feeder over the platen and record a flowing light image of the input information upon the moving photoconductive plate surface P.

Figure 2:
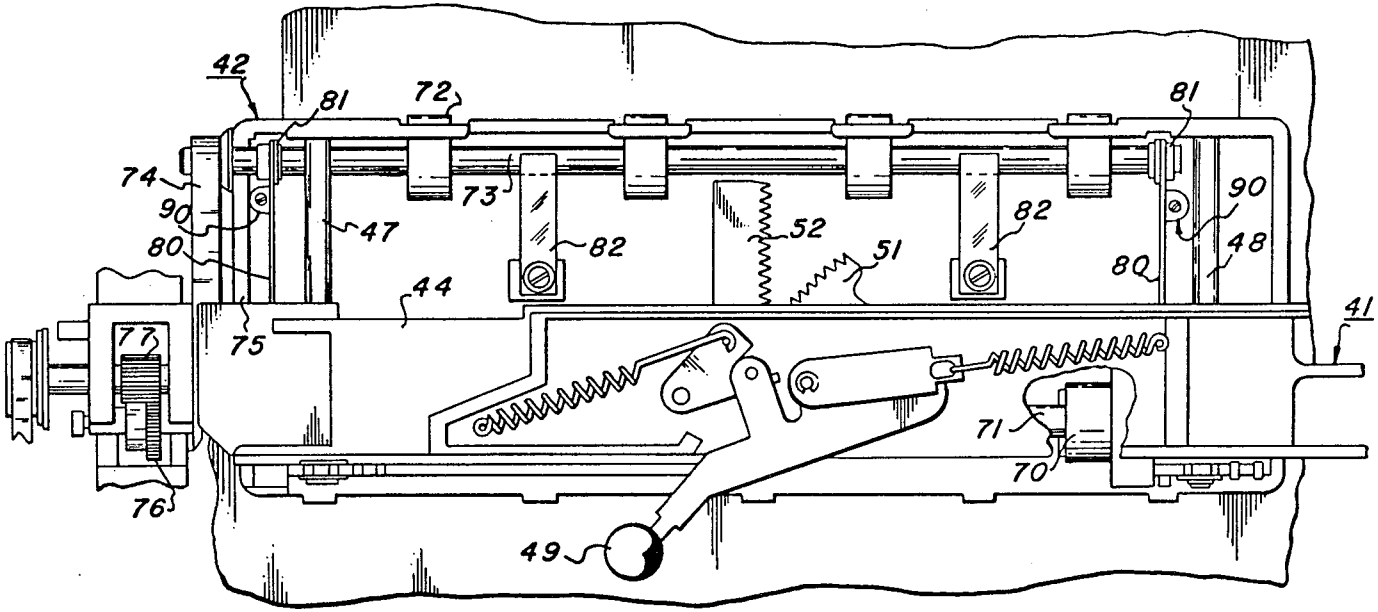
FIG. 2 is a partial top view of the sheet feeding apparatus of FIG. 1.

Referring now more specifically to FIGS. 1 and 2, there is shown the document feeding mechanism 11 associated with the instant invention. During normal operations, that is, when the moving optics are utilized to provide a flowing light image of the stationary original, the document feeding assembly is maintained in a stored position (as depicted by the phantom lines shown in FIG. 1) to expose the entire platen surface area and thus provide a maximum working area to the operator.

To initiate the moving document mode of operation, the machine operator simply advances the document feeding assembly 11 from the stored position to a document feeding position with the feeding assembly extending over the left hand margin of the platen surface. Fundamentally, the document feeding mechanism is made up of two main sections which include a stationary support bridge, generally referenced 41, and a movable feed roller support section, generally referenced 42. The bridge 41 is made up of two vertically extending end support members which are securely anchored in the machine frame and upon which is secured a horizontal span 44. The feed roller support section 42 is slidably suspended from the horizontally extended span 44 by means of a pair of parallel aligned rod like guide rails 47, 48 which are slidably supported in bearings (not shown) affixed to the underside of the bridge span. The document feed roll assembly is thus suspended from the span so that it can be freely moved back and forth from the home or stored position adjacent to the platen 20 and an extended position over the left hand margin of the platen surface.

In practice, at the start of the moving document handling conversion cycle, the machine operator grasps a lever arm 49 mounted on top of the bridge span and rotates the arm in a clockwise direction as shown in FIG. 2. The lever arm is operatively connected to segmented pinion 51 which meshes with a rack 52 secured to the feed roller assembly 42. Movement of the arm in a clockwise direction causes the movable feed roller assembly to be advanced toward the fully extended or operative position. Rotation of the arm in the opposite direction produces the opposite result.

Manually moving the feed roller support assembly 42 to the extended position also physically closes the contacts of the large document mode switch (not shown) causing a signal to be sent to the main machine drive motor (not shown) actuating the motor. At the same time, a signal is also sent to the machine logic control system placing the machine in a single copy mode of operation. This latter step is required in order to move the optical system from its normal rest position, which is the start of scan position at the left hand end of the platen surface, to the end of scan position beneath the now fully extended feed roll assembly. However, during this initial conversion phase, no original is actually being processed and there is, therefore, no need to feed copy sheets through the copier. In point of fact, feeding a copy sheet during the conversion phase would have a deleterious effect on the various machine components as well as confusing the machine programming and registering system. To prevent this occurrence, means 60, as shown in FIG. 1, are provided for inhibiting the action of the paper feeder during the period when the machine is being converted to the moving document mode of operation. Means 61 are provided for locking the optics at the end of scan position during the moving original mode of operation. Means 61 comprises a lock-out mechanism which serves to both uncouple the drive shaft from the main drive system and hold the optics rigidly in a fixed position for viewing moving documents subsequently advanced through the document feeding assembly 11.

Further details of the inbibitor means 60 and lockout means 61 may be obtained by reference to the above-noted U.S. application Ser. No. 367,996.

The movable document feed roller support section 42 of the document feeder assembly is provided with two sets of co-axially aligned feed rollers comprising a first set of drive rollers 70 mounted upon shaft 71 and a second set of hold down rollers 72 mounted upon hold down shaft 73. The two feed roller support shafts are connected by means of a timing belt 74 whereby each set of rollers is adapted to turn in coordination with the other set of rollers. Shaft 71 is arranged to extend beyond the end wall 75 of the movable document feeder roll support section 42 and has a gear 76 pinned thereto. In operation gear 76 is adapted to move into and out of meshing contact with the stationary driven gear 77 as the document feed roller section is moved between a stored and fully extended position. When placed in a fully extended position, as shown in FIG. 2, gear 76 meshes with gear 77 thus causing both the document feed rollers 70 and the hold down feed rollers 72 to be rotated. Directly below the stationary bridge and adjacent to the platen margin are a set of pinch rollers 78 (FIG. 1) which are rotatably supported in the machine frame. The pinch rollers are arranged in the machine frame so as to coact with the feed rollers 70 when the document feeder 11 is in the operative position so as to advance a document introduced therebetween. In operation, the document is moved past the viewing domain of the now fixed optical assembly 21 and then into the pinch between the hold down feed rollers 72 and the platen 20 surface. The hold down rollers 72 serve to hold the document in sliding contact with the platen surface as the original is being moved past the optics and to continue to feed it after it leaves the nip of rollers 70 and 78.

The rolls 70 and 72 in the feeder 11 shown are continuously driven during machine operation even when no sheet is being fed, however, they could be driven if desired only during sheet feeding.

Figure 3:
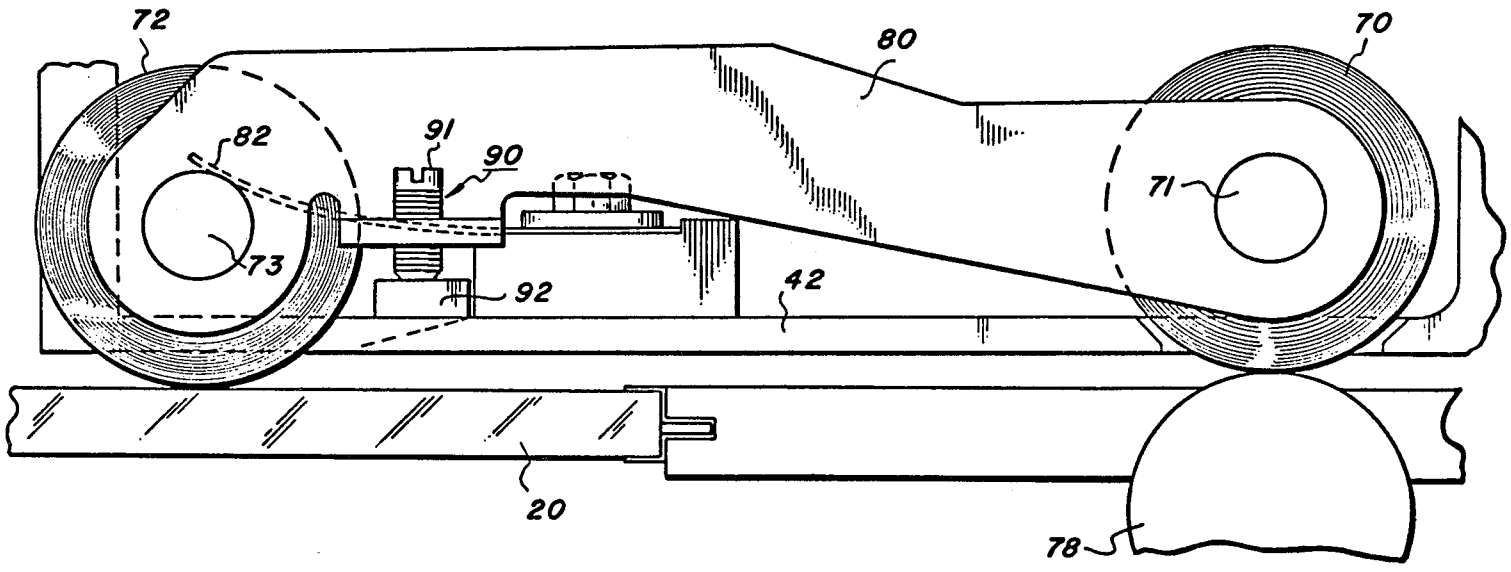
FIG. 3 is a partial side view of the sheet feeding apparatus of FIG. 1.
Figure 4:
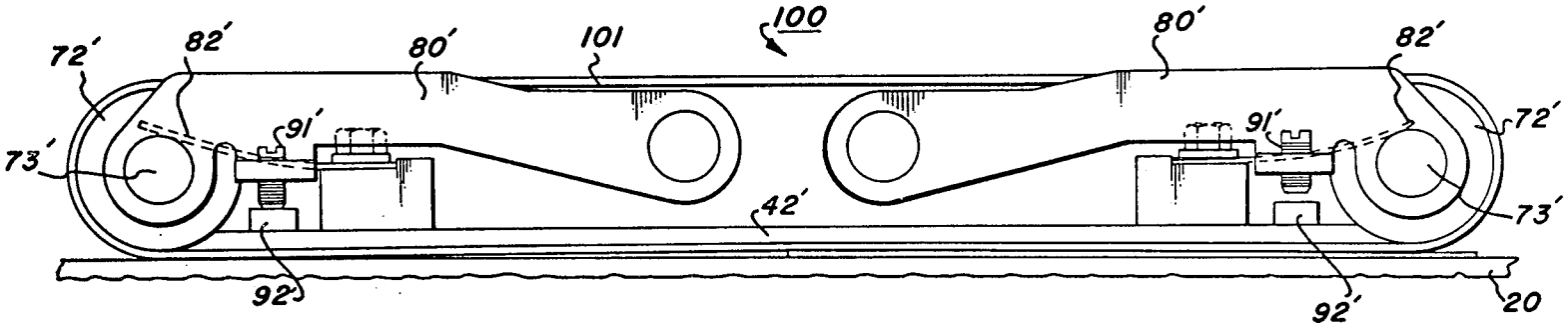
FIG. 4 is a side view of a sheet feeding apparatus in accordance with another embodiment of this invention.

Referring now to FIGS. 2 and 3, it is apparent that the shaft 73 which carries the rolls 72 is pivotably supported against the platen 20 by means of arms 80. The shaft 72 is journaled for rotation in the arms 80 by means of bearings 81. The arms are pivotably supported about the shaft 71. The rolls 72 are biased against the platen by means of leaf springs 82 which act upon the shaft 73. The springs 82 are mounted to the support section 42 in a cantilever fashion. The springs 82 are operative to bias the rolls against the platen with a given force normal to the platen.

The amount of normal force which is to be applied is determined by the amount of force required to properly feed documents across the platen.

In accordance with the teachings of U.S. application Ser. No. 464,725 noted above, a means 90 is provided for reducing the normal force applied to the platen 20 when no sheet is being fed so as to reduce platen abrasion. In the embodiment shown, this reducing means 90 comprises a set screw 91 in threaded engagement in each of the pivoting arms 80 which support the hold down rolls 72 and an anvil 92 supported by the feed roll support section 42. By adjusting the set screws 91 in against the anvils 92 the arms 80 are lifted against the action of the leaf springs 82. Therefore, a portion of the force which is applied by the leaf springs against the shaft 73 is taken up or absorbed by the set screw and anvil arrangement, thereby reducing the normal force applied by the rolls 72 against the platen glass 20.

In accordance with this invention the holddown feed rollers 72 are formed of a multi-component material comprising a solid polymeric component impregnated with a non-volatile liquid component. The liquid component serves to reduce the roll 72 to platen 20 coefficient friction of the multi-component material as compared to a roll formed solely of the solid polymeric component. The multi-component material is selected so as to reduce the difference between the coefficient of friction between the rolls 72 and the platen 20 and the coefficient of friction between the document and the platen. By reducing this difference in coefficient of friction the aforenoted improvements in the operation of the document feeder 11 result. This substantially reduces the occurrence of non-synchronous movement of the document due to the complaince of the document feeder 11.

Preferably the non-volatile liquid acts as a moisture barrier to minimize the changes in coefficient of friction of the roll 72 material with humidity. The difference between the roll-to-platen coefficient friction and the document-to-platen coefficient of friction preferably is less than about 0.8 and most preferably less than about 0.5 as measured with a clean platen 20 and a clean roll 72 at about 65 percent relative humidity. A particularly preferred material in accordance with this invention comprises a solid polyurethane component impregnated with a silicone oil component. Preferably the silicone oil component comprises polydimethylsiloxane oil in an amount from about 5 to about 20 percent by weight with the balance of the roll material being polyurethane. A silicone oil component of about 10 percent by weight has been found to have particular utility.

The rolls may be formed by any desired means. The solid polyurethane component can be formed with a desired degree of porosity and the silicone oil then impregnated into it by the application of pressure. In accordance with other well known techniques the liquid component can be mixed into a bath of molten polyurethane which is then cast so that the liquid component is impregnated in the solidified polyurethane. The particular method by which the rolls 72 are formed does not form part of the present invention, and any desired approach for forming a multi-component roll in accordance with the present invention could be employed.

Comparative tests were performed comparing a number of conventional roll 72 materials including a multi-component roll material in accordance with the present invention. The coefficient of friction between these rolls and a glass platen, and the coefficient of friction between the paper and the glass were measured. Among the materials tested were solid polyurethane rolls, Hypalon rolls, EPDM rolls, Silastic rubber rolls, and polyurethane rolls 72 impregnated with 10 percent silicone oil in accordance with the present invention. The tests were carried out at a variety of relative humidities. The rolls 72 in accordance with the present invention of all of the rolls tested had the lowest difference between the roll-to-glass coefficient of friction and paper-to-glass coefficient of friction. The rolls 72 of this invention also exhibited a substantially reduced tendency toward increasing roll-to-glass coefficient of friction with increasing humidity.

These tests established the unusual nature of the roll material in accordance with the present invention in reducing this mismatch in coefficients of friction. This would be expected as aforenoted to substantially reduce the occurrence of non-synchronous document feeding.

While the invention has thus far been described with reference to the use of rolls as the feeding member, it would be equally applicable to a belt-type document feeding system 100 as shown in FIG. 5. A web or belt 101 is supported about roll 72'. The rolls 72' are biased against the platen 20 by means of leaf springs 82' just as in the previous embodiment. The rolls 72' are also pivotally supported by means of pivot arms 80' and each pivot arm includes a set screw 91'. The roll support 41' carries anvil 92' as in accordance with the previously described feeder.

In accordance with this invention the web or belt 101 could be formed from a multi-component material comprising a flexible solid polymeric component and a non-volatile liquid component as previously described. It is, of course, recognized in the art that the polyurethane component can be provided with any desired degree of flexibility by well known techniques.

The patents and applications specifically set forth in this application are meant in every respect to be incorporated by reference into the description.

It is apparent that there has been provided in accordance with this invention, a document feeding apparatus which fully satisfies the objects, means and advantages set forth hereinbefore. While the invention has been described in conjunction with specific embodiments thereof, it is evident that many alternatives, modifications and variations will be apparent to those skilled in the art in light of the foregoing description. Accordingly, it is intended to embrace all such alternatives, midifications and variations as fall within the spirit and broad scope of the appended claims.

What is claimed is:

1. A moving document exposure apparatus comprising:

a viewing platen;

a photosensitive surface arranged for movement;

means for viewing a document at said platen and for projecting an image thereof onto said photosensitive surface;

means for feeding said document over said platen and past said viewing means in synchronism with the movement of said photosensitive surface, said feeding means including at least one feed member urged against said platen to form a nip therebetween for passage of said document, said feed member being formed of a multi-component material comprising a solid polymeric component impregnated with a non-volatile liquid component, said material being selected to reduce the difference between the feed member-to-platen coefficient of friction and the document-to-platen coefficient of friction.

2. An apparatus as in claim 1, wherein said multi-component material is selected so that said difference between said coefficients of friction is less than about 0.8.

3. An apparatus as in claim 2, wherein said non-volatile liquid component comprises from about 5 to about 20 percent by weight of said material.

4. An apparatus as in claim 3, wherein said solid polymeric component comprises polyurethane and wherein said non-volatile liquid component comprises silicone oil, whereby said material is less sensitive to moisture effects than polyurethane alone.

5. An apparatus as in claim 3, wherein the difference between said coefficients of friction comprises less than about 0.5.

6. An apparatus as in claim 5, wherein said feed member comprises at least one roll.

7. An apparatus as in claim 5, wherein said feed member comprises a web.

8. An apparatus as in claim 5, wherein said viewing means comprises optical means.

9. An apparatus as in claim 8, wherein said optical means comprises a scanning optical means for scanning a document on said platen, said scanning optical means being fixable at a given position, and said feed member being arranged to feed said documents past said fixed scanning means in synchronism with the movement of said photosensitive surface.

10. An apparatus as in claim 9, wherein said feed member is movable between an operative position in contact with said platen and an inoperative position spaced from said platen.

11. An apparatus as in claim 8, wherein said apparatus comprises an electrostatographic apparatus wherein said optical means forms an electrostatic image on said surface and said apparatus further includes means for developing said electrostatic image to render it visible.

* * * * *